United States Patent [19]

Dailey et al.

[11] 4,138,873

[45] Feb. 13, 1979

[54] TOOL FOR FORMING RECTANGULAR CROSS-SECTIONAL CONDUIT ENDS

[75] Inventors: George F. Dailey, Plum Borough; James S. Koroly, North Huntingdon Township, Huntingdon County, both of Pa.

[73] Assignee: Westinghouse Electric Corp., Pittsburgh, Pa.

[21] Appl. No.: 875,669

[22] Filed: Feb. 6, 1978

[51] Int. Cl.[2] ..... B21D 39/08

[52] U.S. Cl. ..... 72/316; 72/355; 72/392

[58] Field of Search ..... 72/355, 392, 454, 316, 72/318

[56] References Cited

U.S. PATENT DOCUMENTS

| | | | |
|---|---|---|---|
| 1,935,714 | 11/1933 | Hummell | 72/316 |
| 2,780,122 | 2/1957 | McCown | 72/392 |
| 2,784,623 | 3/1957 | Reynolds | 72/392 |
| 3,060,994 | 10/1962 | Larsen et al. | 72/392 |
| 3,109,479 | 11/1963 | Wolcott | 72/454 |

*Primary Examiner*—Lowell A. Larson
*Attorney, Agent, or Firm*—J. W. Keen

[57] ABSTRACT

A tool for forming substantially rectangular cross sections on conduits. Two mateable collars are disposable about the exterior of a conduit and have forming surfaces which can be pressed against the conduit's wall to predetermined extents to cause the conduit to assume the desired outside rectangular dimensions. Such pressing is provided by two threaded fasteners, each of which extend through one of the collar members and into threaded engagement with the mateable collar. The assembled collar configuration may be disengaged from, rotated about, and reclamped on the exterior of the conduit so as to provide uniform wall formation if the shape of the desired conduit permits such collar rotation. To assure complete contact between the conduit's exterior and the forming surfaces of the collar, two wedge members are axially inserted in the conduit's opening.

7 Claims, 12 Drawing Figures

TOOL FOR FORMING RECTANGULAR CROSS-SECTIONAL CONDUIT ENDS

BACKGROUND OF THE INVENTION

1. Field of the Invention

This invention relates to conduit formation and more particularly to a tool which provides phase ring shapes and dimensions suitable for joining with standard sized sleeves.

2. Description of the Prior Art

Large dynamoelectric machines such as turbine generators often include hollow phase rings and arcuate extensions thereto which connect external main bushings to various phase winding terminating portions. The phase rings are usually hollow to accommodate internal coolant flow therethrough for the removal therefrom of electrical heating. The phase rings and arcuate extensions thereof are commonly square or rectangular cross-section hollow copper conduit. Typically, a number of bends must be formed in the phase rings and arcuate extensions to avoid interference with other generator components. It has been found advantageous to assemble phase ring components rather than form a phase ring of complex shape from a single straight piece of copper conduit.

Joining separate phase ring components into a phase ring assembly has, heretofore, been accomplished by brazing the connecting joints. Such connection joints are commonly of the scarf or miter type. A disadvantage of such scarf and miter joints is that they cannot be routinely inspected through their thickness by non-destructive ultrasonic testing means. Additionally, ultrasonic testing is not feasible in the axial direction along the joint since the portions of the phase ring components adjacent the joint are typically curved rather than straight and are thus not susceptible to ultrasonic analysis of the brazed joint. Joint quality of such a brazed joint is usually quantified by estimating a percent bond. Such estimate can be highly speculative and vary substantially from inspector to inspector.

U.S. Pat. No. 1,725,592, which was patented Aug. 20, 1929, illustrates a method of forming a square crosssectional conduit by using a former such as a vise on the exterior of the conduit and a mandrel on the interior of the conduit. The one-piece mandrel 2 illustrated in the aforementioned patent can be difficult to insert and extract subsequent to the forming operation. Use of the method disclosed in the aforementioned patent would be highly disadvantageous for use on retrofitting or repairing phase rings in an assembled dynamoelectric machine such as a generator. Space limitations in such machines require compact driving mechanisms for supplying the exterior and interior force necessary to properly form the conduit or, in the case of the prior art patent, dry cell container. As such, the illustrated apparatus could be utilized to form square conduit ends in such manner as to cause them to be suitable for joining with a sleeved joint only in work areas providing substantial access to the work pieces and drive equipment.

Primary problems associated with prior art phase ring joints and the tools to make those joints include the difficulties encountered in performing ultrasonic inspection tests thereon, tool complexity, and the large space requirements for operating the tools.

SUMMARY OF THE INVENTION

In accordance with the present invention, a forming tool is provided for shaping the end portions of rectangular cross-section conduit so as to enable assembly with suitable, standardized sleeves and permit formation therewith of close clearance sleeved joints. The invention generally comprises two mateable collars each having a notch in its mateable edge, said notches cooperating during collar member assembly to form a substantially rectangular opening which is bounded by forming surfaces, means for engaging the collar members' forming surfaces against the conduit's outer periphery, operationally stationary and operationally mobile wedge members which are cooperatively insertable in the conduit opening with the wedges being slidingly mateable along a parting plane and each having a conduit forming surface which is engageable with the conduit's inner periphery, means for securing the stationary wedge member to said collar members, and means for inserting said mobile wedge into the conduit's opening between the stationary wedge's mateable surface and the conduit's inner periphery.

In the preferred embodiment of this invention a pair of threaded fasteners are each disposed through at least one collar member and into threaded engagement with the other collar member with those threaded fasteners being disposed on substantially opposite sides of the rectangular opening in the assembled collars. In such preferred embodiment a nut in threaded engagement with a rod provides the driving force during its rotation for inserting the mobile wedge member into the unobstructed space between the stationary wedge member and the conduit wall. The rod preferably extends across the parting plane separating the wedge members and has an enlarged end situated within the conduit for limiting mobile wedge member's insertion distance and for restraining the rod in cooperating, abutting relationship with the stationary wedge member. The wedge members' forming surfaces and the collar members' forming surfaces are convex and concave, respectively.

A load distribution member is preferably disposable between the driving nut and the mobile wedge member to evenly distribute the nut's driving force to the mobile wedge member so as to slidably displace the mobile wedge member relative to the stationary wedge member along the parting plane. The stationary wedge member is preferably securable to at least one of the collar members with a threaded fastener and is operationally disposed in the fully inserted position in the conduit opening. Means are also provided for opposing threaded rod rotation during driving nut rotation and thus permit relative axial displacement of the driving nut on the threaded rod. An additional threaded fastener in threaded engagement with the mobile wedge member is seatable against the collar members and thus provides, when suitably rotated, mobile wedge extraction from the conduit's opening.

BRIEF DESCRIPTION OF THE DRAWINGS

The invention will be more fully understood from the following detail description of a preferred embodiment, taken in connection with the accompanying drawings, in which.

DESCRIPTION OF THE PREFERRED EMBODIMENT

The present invention is concerned primarily with means for shaping conduit ends to rectangular shaped crosssections of predetermined size so as to permit standard sized sleeves to be utilized in conjunction with two of the conduit ends to form a sleeved joint which is easily inspected with conventional ultrasonic testing procedures. Large dynamoelectric machines such as turbine generators often have parallel phase rings which are connected with externally disposed terminal bushings. Such phase rings and extensions thereto are normally rectangular in cross-section and have joints therein for connecting together various parts of each phase ring.

Figure 1A:
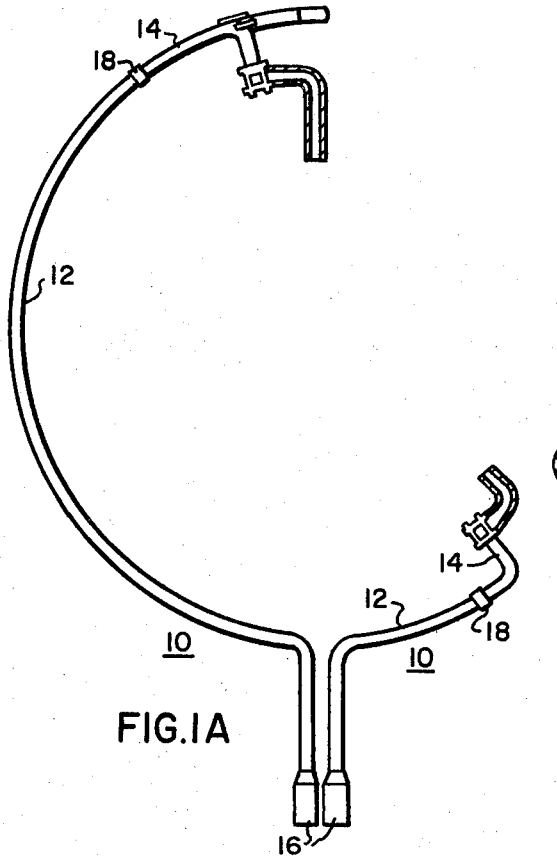
FIGS. 1A–1C are elevation views of three phase rings and the connected, external bushings.
Figure 1B:
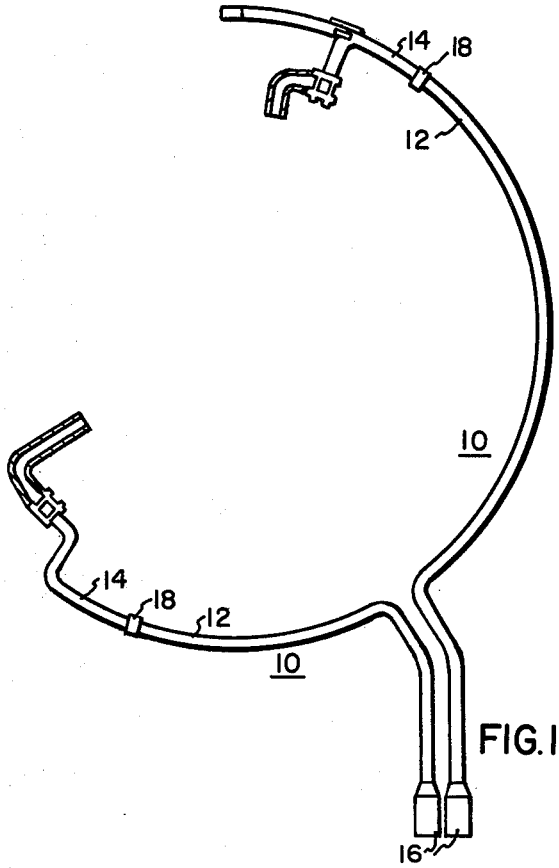
Figure 1C:
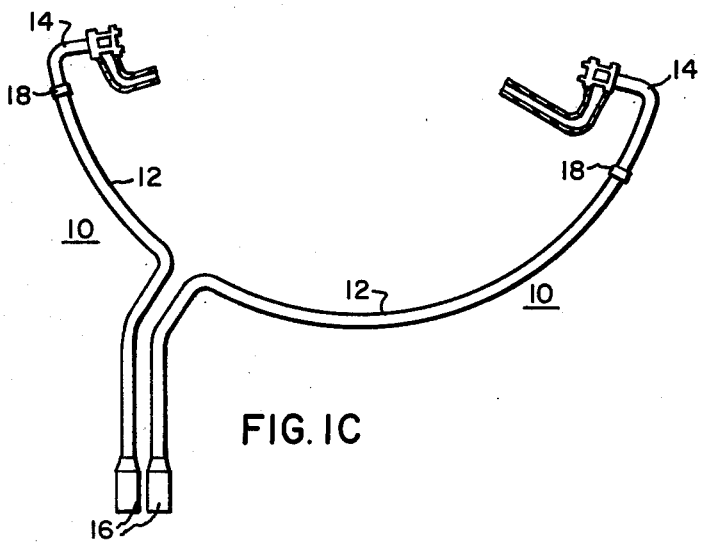

FIGS. 1A, 1B, and 1C illustrate phase rings 10 which include principal components 12 and arcuate extensions 14 connected thereto at one end and bushings 16 connected at principal component 12's other end. The phase rings illustrated in FIGS. 1A, 1B, and 1C are cooperatively utilized in three-phase dynamoelectric machines such as turbine generators. Due to the large number of bends and discontinuities required in the phase rings 10 to avoid interference with other generator components, phase rings 10 can seldom be formed from a single piece of straight copper conduit. Thus, joints 18 are necessary to connect principal component 12 to arcuate extensions 14, principal components 12 together, and/or arcuate extensions 14 together.

Figure 2A:
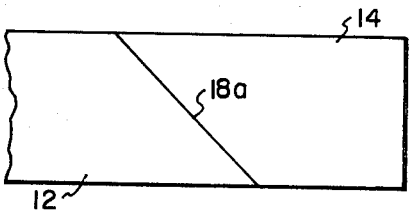
FIG. 2A PRIOR ART
FIGS. 2A and 2B are prior art phase ring joints.
Figure 2B:
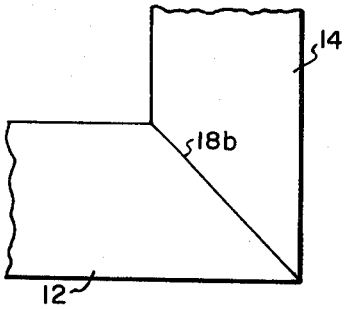
FIG. 2B PRIOR ART

FIGS. 2A and 2B illustrate prior art joints used to connect principal component 12 and arcuate extension 14.

FIG. 2A illustrates a scarf joint 18*a* and FIG. 2B illustrates a miter joint 18*b*. The joints 18*a* and 18*b* are currently formed by using a brazing alloy such as silver-phosphorus. The scarf and miter joints, however, cannot be ultrasonically inspected through their thickness due to the necessity of having a continuum of testing material that has a greater thickness than typical phase ring conduit wall.

Figure 3:
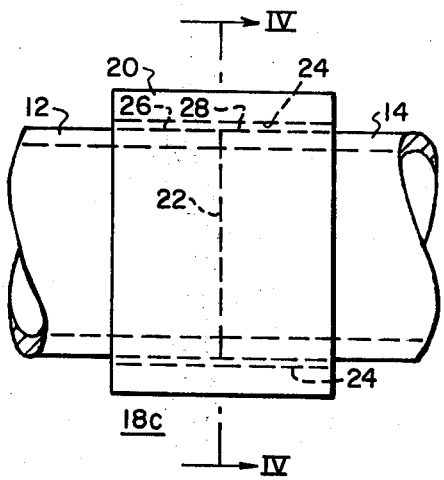
FIGS. 3 and 4 are transverse sectional views of a sleeved joint formed in one of the phase rings or extensions thereto.
Figure 4:
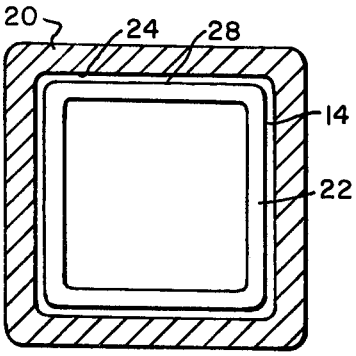

FIGS. 3 and 4 illustrate a sleeved joint 18*c* which permits ultrasonic inspection thereof across its thickness. Sleeve 20 is disposed about the exterior of principal component 12 and arcuate extension 14 which are assembled in abutting relationship. Sleeve 20 overlaps abutting interface 22 in both axial directions for predetermined distances which are sufficient to provide, when metallurgically bonded, a strong, substantially fluid-tight joint. Metallurgical bonding such as brazing sleeve 20 to principal component portion 12 and arcuate extension 14 requires clearances between sleeve 20's inside surface 24 and the outside surfaces 26 and 28 of components 12 and 14, respectively, to be held to a maximum of approximately 0.003 inches on each side. The phase ring components 12 and 14 are usually formed into circular or arcuate portions from straight pieces of hollow copper conduit. Formation of such circular or arcuate shapes causes deformation and flow of copper in those conduit portions resulting in conduit components whose dimensions are altered from the original, straight pieces. To contol clearances between phase ring components and a mateable sleeve to 0.003 inches or less on a side necessitates precise milling of the ends of the abutting phase ring components 12 and 14. Components 12 and 14 are, however, often of such shape as to make the milling operation highly impracticable. Additionally, formation of sleeved phase ring joints for field repairs often precludes the milling operation due to lack of space within the generator or not having a readily available milling machine.

Figure 5A:
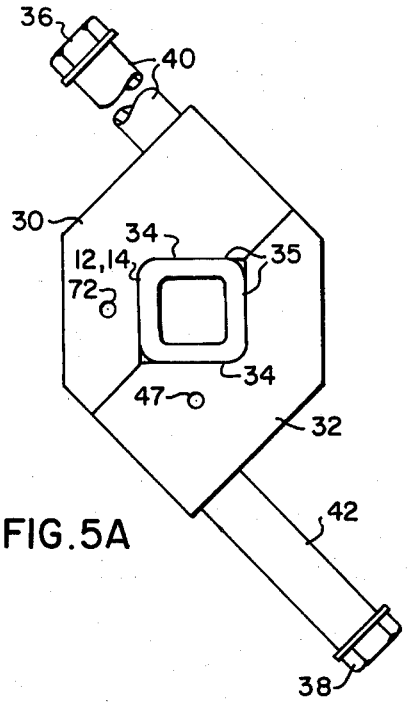
FIGS. 5A–5E are elevation and sectional views of the present invention conduit shaping apparatus.

By use of the invention illustrated in FIGS. 5A–5E, milling of component pieces 12 and 14 is no longer necessary to provide a controlled clearance between inside surface 24 of standardized sleeve 20 and the outside surfaces 26 and 28 of component pieces 12 and 14. A conduit end shaping apparatus obviates the need for the milling operation by controlling the conduit ends' dimensions. FIG. 5A illustrates the shaping apparatus for the outer periphery 26 and 28 of phase ring components 12 and 14 respectively. Mateable collar portions 30 and 32 each have a notch 34 formed along its mateable surface with those notches cooperating when collar portions 30 and 32 are assembled to form a rectangular opening 35 whose shape and dimensions are those desired for the exterior of components 12 and 14. Threaded fasteners such as bolts 36 and 38 are extendible through one of the collar portions and into threaded engagement with the mateable collar portion. Selective tightening of bolts 36 and 38 cause conduit components 12 and 14 to assume the desired dimensions. Dowels 40 and 42 ensure mateability of the collar portions 30 and 32 and the proper alignment of the bolt holes in those collar portions. For the tool illustrated in FIGS. 5A-5E the desired conduit shape is square and thus permits loosening bolts 36 and 38, rotating the mateable collars, and retightening bolts 36 and 38.

Figure 5B:
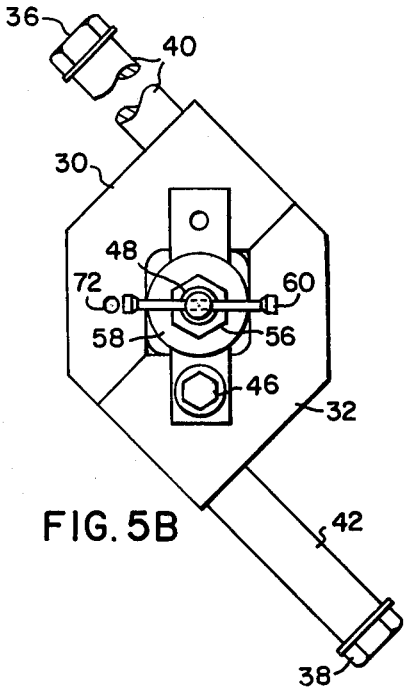
Figure 5C:
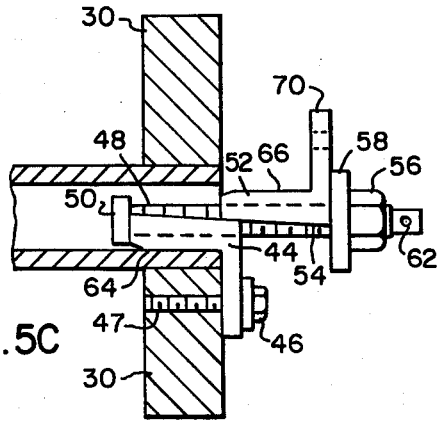

To assure contact between collar opening 35 and the outer surface of phase ring conduit workpiece, wedges are inserted in the conduit's end which causes the conduit's walls to be swagged outward against the walls of opening 35. A stationary wedge 44 is disposed in the conduit opening as shown in FIG. 5C and secured in place by inserting threaded fastener 46 through a flange attached thereto and into threaded engagement with collar member 32. Threaded rod member 48 has an enlarged end 50 which is cooperatively inserted with stationary wedge member 44 into the conduit opening. Mobile wedge member 52 is slidably engaged with stationary wedge member 44 and threaded rod 48. To ensure wedge stability during insertion, the centerline of rod 48 should preferably cross parting plane 54 along which wedge members 44 and 52 are slidingly mateable. Appropriate rotation of nut 56 which is in threaded engagement with rod 48 results in an axial displacement of nut 56 and mobile wedge member 52 which is preferably in indirect contact therewith. Load distribution member 58 which is insertable between mobile wedge 52 and driving nut 56 evenly distributes the driving force generated by nut 56 to mobile wedge member 52. Interconnection of the stationary forming members (collars 30, 32 and stationary wedge 44), restraints imposed thereby on rod 48, and the mobile wedge 52's cooperative association with rod 48 results in a self-contained forming structure requiring mp additional supporting arrangement or external driving mechanism.

Rotation of rod 48 during rotation of driving nut 56 is avoided by restraining handle 60 which extends through transverse hole 62 in rod 48. Enlarged rod end 50 axially restrains rod 48 by overlapping the adjacent axial end of stationary wedge member 44 and also acts as a stopping member for mobile wedge member 52.

Figure 5D:
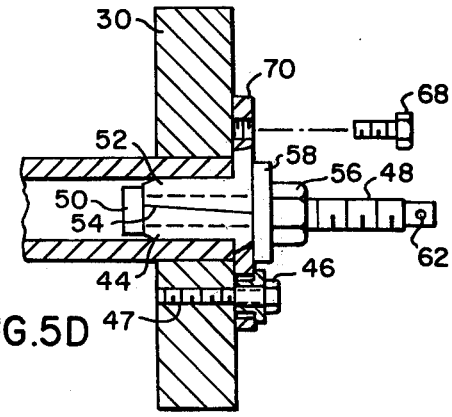
Figure 5E:
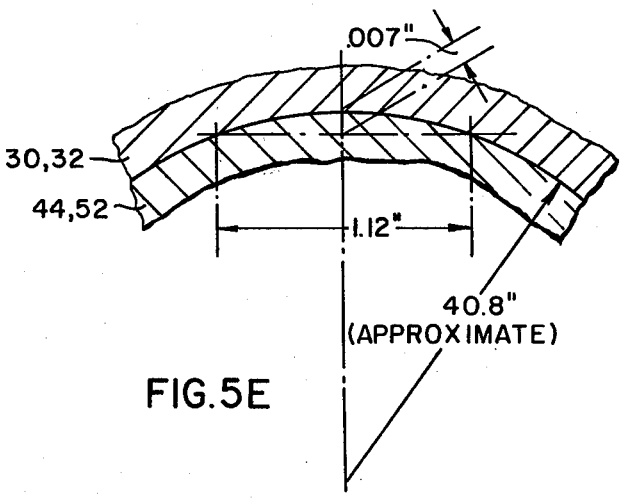

FIGS. 5C and 5D respectively illustrate the shaping apparatus' relative configuration before and after insertion of mobile wedge member 52 in the conduit's end. The surfaces bounding collar opening 35 are concave and surfaces 64 and 66 of the wedge members are convex to account for the conduit's copper "springback" which occurs when mobile wedge member 52 is removed from the conduit's opening. The degree of concavity and convexity is primarily a function of the conduit's material and in the case of a copper 2 inch × 2 inch conduit with ⅜ inch thick walls the concavity is 0.007 inches. Threaded fastener 68 is in threaded engagement with flange 70 which is attached to mobile wedge member 52. Disengagement of mobile wedge member 52 from the conduit's opening is accomplished by appropriately rotating threaded fastener 68 to cause it to abut collar member 30 and separate mobile wedge member 52 from it. The remaining, unswagged conduit walls are shaped by disposing threaded fastener 46 in hole 72 which is illustrated in FIG. 5B and reinserting the mobile wedge member 52 in the conduit's opening.

The present invention's forming components such as wedges 44 and 52 preferably constitute hardened steel which resists dimensional alteration otherwise resulting from the present invention's repeated use in the aforementioned shaping operations. Utilizing such hardened shaping components permits the use of abrasive tools such as belt sanders to grind each phase ring component substantially flush with the still-assembled hardened collars 30 and 32. Such abrasive should be chosen to have little or no effect on the hardened collars if brought into contact therewith during the grinding operation. The resulting smooth phase ring component ends may, thereafter, be assembled in abutting relationship so as to form a precise butt joint within the overlying sleeve. It is to be understood that a brazing material insert may be disposed axially between the phase ring components prior to the sleeve-phase ring brazing operation to further improve the quality of the sleeved joint after brazing.

It will now be apparent that an improved phase ring forming apparatus has been provided in which controlled conduit shapes and dimensions can be obtained so as to maintain a predetermined clearance between the shaped conduit's outer periphery and standardized sleeves which are mateable therewith and facilitate the formation of a high quality, high strength, brazed, sleeved joint. The shaping apparatus is portable, easily operated, and may be adapted to other shapes and dimensions by changing the size and shape of the notches 34, the wedge members 44 and 52, and other parts which require only scaling up or down. Additionally, this shaping tool can be used when access to the phase rings in question is very limited.

We claim:

1. An apparatus for shaping rectangular crosssections on conduit end portions, said apparatus comprising:

two mateable collar members each having a notch in its mateable edge, said notches cooperating during collar member assembly to form a substantially rectangular opening which is bounded by forming surfaces;

means for compressively engaging said collar member's forming surfaces against a conduit's outer periphery;

an operationally stationary wedge member and an operationally mobile wedge member each of which has a forming surface, said forming surfaces being engageable with the conduit's inner periphery during insertion of said wedge members in the conduit's opening, said wedge members having surfaces which are slidably mateable along a parting plane;

means for securing said stationary wedge member to at least one of said collar members, said stationary wedge member being securable in the conduit's opening; and means for inserting said mobile wedge between the stationary wedge member's mateable surface and the inner periphery.

2. The apparatus of claim 1, said compressive engagement means comprising:

a first and second threaded fastener each disposed through at least one collar member and in threaded engagement with the other collar member, said threaded fasteners, when assembled with said collars, being substantially parallel and disposed on substantially opposite sides of said rectangular opening.

3. The apparatus of claim 1, said mobile wedge inserting means comprising:

a threaded rod insertable between said wedge members, the centerline of said rod extending across said parting plane, said rod having an enlarged end for limiting the insertion of said wedge members within the conduit opening; and a nut in threaded engagement with said threaded rod, said wedge members being disposable between said enlarged rod end and said nut wherein said nut, when suitably rotated on said rod, drives said mobile wedge member into said conduit's opening.

4. The apparatus of claim 3, further comprising:

a load distribution member disposable between said nut and said mobile wedge member to evenly distribute the nut's driving force to the mobile wedge member.

5. The apparatus of claim 3, further comprising:

means for opposing threaded rod rotation during nut rotation thereon.

6. The apparatus of claim 1 wherein said wedge member's forming surfaces and said collar member's forming surfaces are, to predetermined extents, convex and concave, respectively.

7. The apparatus of claim 1, further comprising:

a third threaded fastener in threaded engagement with the mobile wedge member, said third threaded fastener being seatable against said collar members to provide mobile wedge disengagement from the conduit's opening.

* * * * *